United States Patent [19]

Reiter

[11] Patent Number: 4,972,539

[45] Date of Patent: Nov. 27, 1990

[54] AUTOMATIC-ASSEMBLY BRIDGE, RAMP AND THE LIKE

[75] Inventor: Rudolf Reiter, Vimercate, Italy

[73] Assignee: Reiter & Crippa Industriale S.P.A., Milan, Italy

[21] Appl. No.: 385,017

[22] Filed: Jul. 25, 1989

[30] Foreign Application Priority Data

Aug. 2, 1988 [IT] Italy ..... 21623 A/88

[51] Int. Cl.[5] ..... E01D 15/12

[52] U.S. Cl. ..... 14/2.4; 14/71.7

[58] Field of Search ..... 14/2.4, 71.7

[56] References Cited

U.S. PATENT DOCUMENTS 4,602,399 7/1986 Jenkins ..... 14/2.4

4,649,587 3/1987 McFarlane et al. ..... 14/2.4

FOREIGN PATENT DOCUMENTS 2252428 5/1973 Fed. Rep. of Germany ..... 14/2.4

*Primary Examiner*—William P. Neuder

*Attorney, Agent, or Firm*—Wolf, Greenfield & Sacks

[57] ABSTRACT

The automatic-assembly bridge, ramp and the like comprises a base segment which has, on one face, two sets of wheels provided with positioning means for disengaging from the ground when the bridge, ramp and the like is installed, as well as an articulation for releasably coupling to a tractor. A second segment is articulated at one end of the base segment and is constituted by a first track and a second track which can be arranged mutually side by side and can be rotated independently from one another so as to be arranged in a transport position, wherein the tracks of the second segment are superimposed on the base segment, and in an installation position, wherein the tracks are arranged substantially along the extension of the base segment. One of the tracks acts as ballast during the rotation of the other track.

15 Claims, 3 Drawing Sheets

AUTOMATIC-ASSEMBLY BRIDGE, RAMP AND THE LIKE

BACKGROUND OF THE INVENTION

The present invention relates to an automatic-assembly bridge, ramp and the like.

As known, bridges, ramps or the like which can be installed in a relatively short time in case of natural disasters or military conflicts are already commercially available.

Such bridges currently pose considerable problems regarding their transport and installation, since it is necessary to use tracked vehicles to transport them to the installation site and external lifting means are generally required to put the bridge or ramp in place.

Known bridges or ramps are generally provided by means of elements which mutually extend from one another and generally do not have sufficiently wide useful spans.

Another disadvantage which can be ascribed to the solutions of the known art is constituted by the fact that the bridges, ramps and the like currently in use require assembly times which are excessively long and are furthermore significantly constrained by the operative limitations of the installation site.

SUMMARY OF THE INVENTION

The aim of the invention is indeed to eliminate the above described disadvantages by providing an automatic-assembly bridge, ramp and the like which can be easily transported on roads with a simple tractor for semi-trailers, thus making its transport to the installation site very easy and rapid.

Within the scope of the above described aim, a particular object of the invention is to provide a bridge, ramp and the like which does not require external operating means for its assembly since it is automatically assembled, in that the elements which allow its unfolding are directly incorporated, allowing to install it in extremely short times, in the order of about ten minutes, without being substantially affected by the conditions of the installation site.

Another object of the present invention is to provide a bridge, ramp and the like which can reach considerable useful lengths without creating dangerous conditions during the installation stage.

Not least object of the present invention is to provide an automatic-assembly bridge, ramp and the like which by virtue of its peculiar constructive characteristics is capable of giving the greatest assurances of reliability and safety in use.

The above described aim, as well as the objects mentioned and others which will become apparent hereinafter, are achieved by an automatic-assembly bridge, ramp and the like, characterized in that it comprises a base segment which has, on one face, at least one set of wheels provided with positioning means for disengaging from the ground when the bridge, ramp and the like is installed, and means for releasably coupling to a tractor, at least a second segment being articulated to one end of said segment, said second segment being constituted by a first track and by a second track which can be arranged mutually side by side and can be rotated independently from one another so as to be arranged in a transport position, wherein said tracks of said second segment are superimposed on said base segment, and in an installation position, wherein said tracks are arranged substantially along the extension of said base segment, one of said tracks being adapted to act as ballast during the rotation of the other.

BRIEF DESCRIPTION OF THE DRAWINGS

Further characteristics and advantages will become apparent from the description of a preferred but not exclusive embodiment of an automatic-assembly bridge, ramp and the like, illustrated only by way of non-limitative example in the accompanying drawings, wherein.

DESCRIPTION OF THE PREFERRED EMBODIMENT

Figures 1, 2, 3, 7:
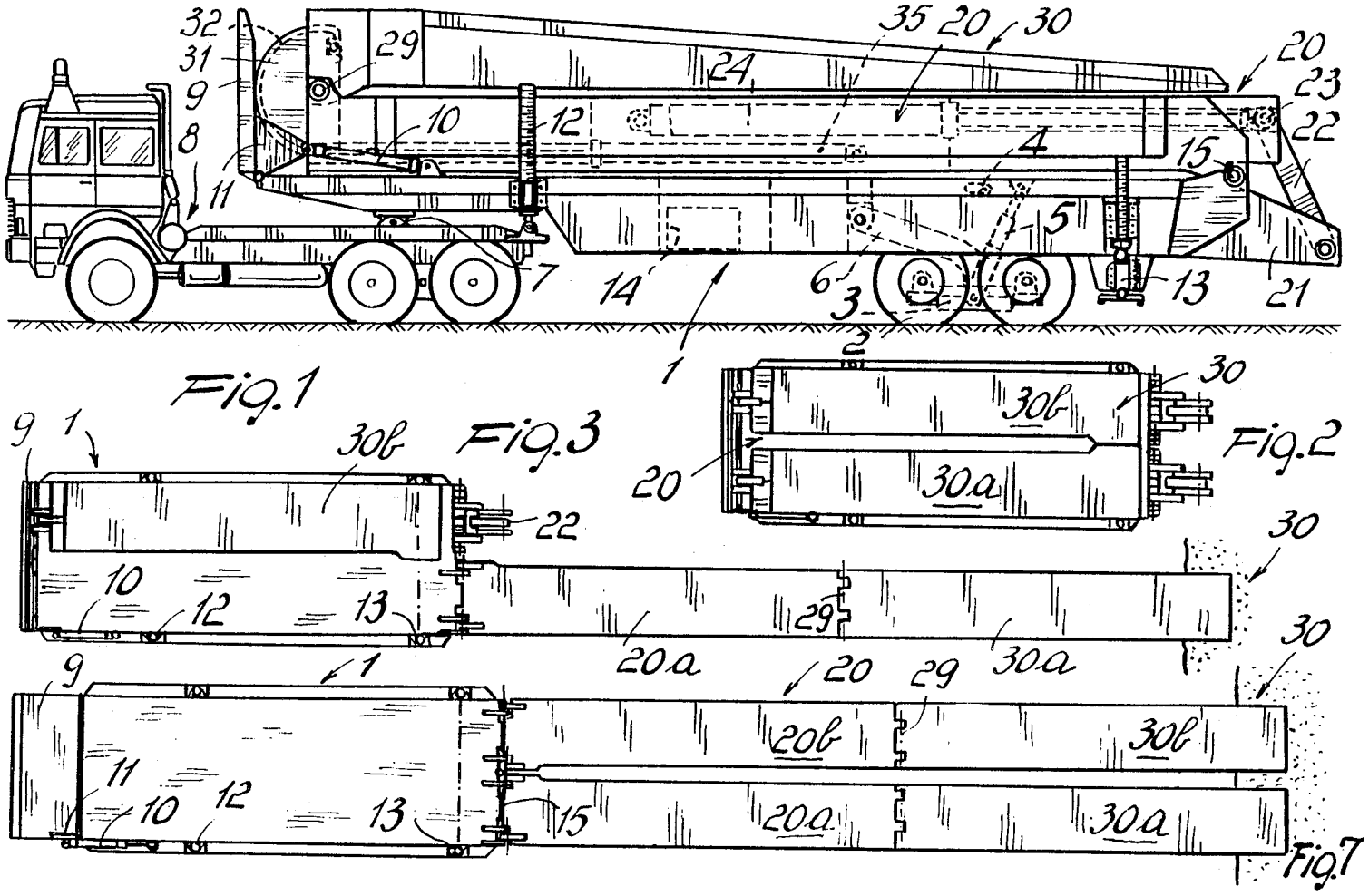
FIG. 1 is a schematic lateral elevation view of the bridge, ramp and the like, applied to a transport tractor.
FIG. 2 is a top plan view of the bridge with the elements folded onto the base segment.
FIG. 3 is a schematic top plan view of the bridge after one of the tracks has been positioned.
FIG. 7 is a plan view of the bridge with both tracks positioned.
Figures 4, 5, 6:
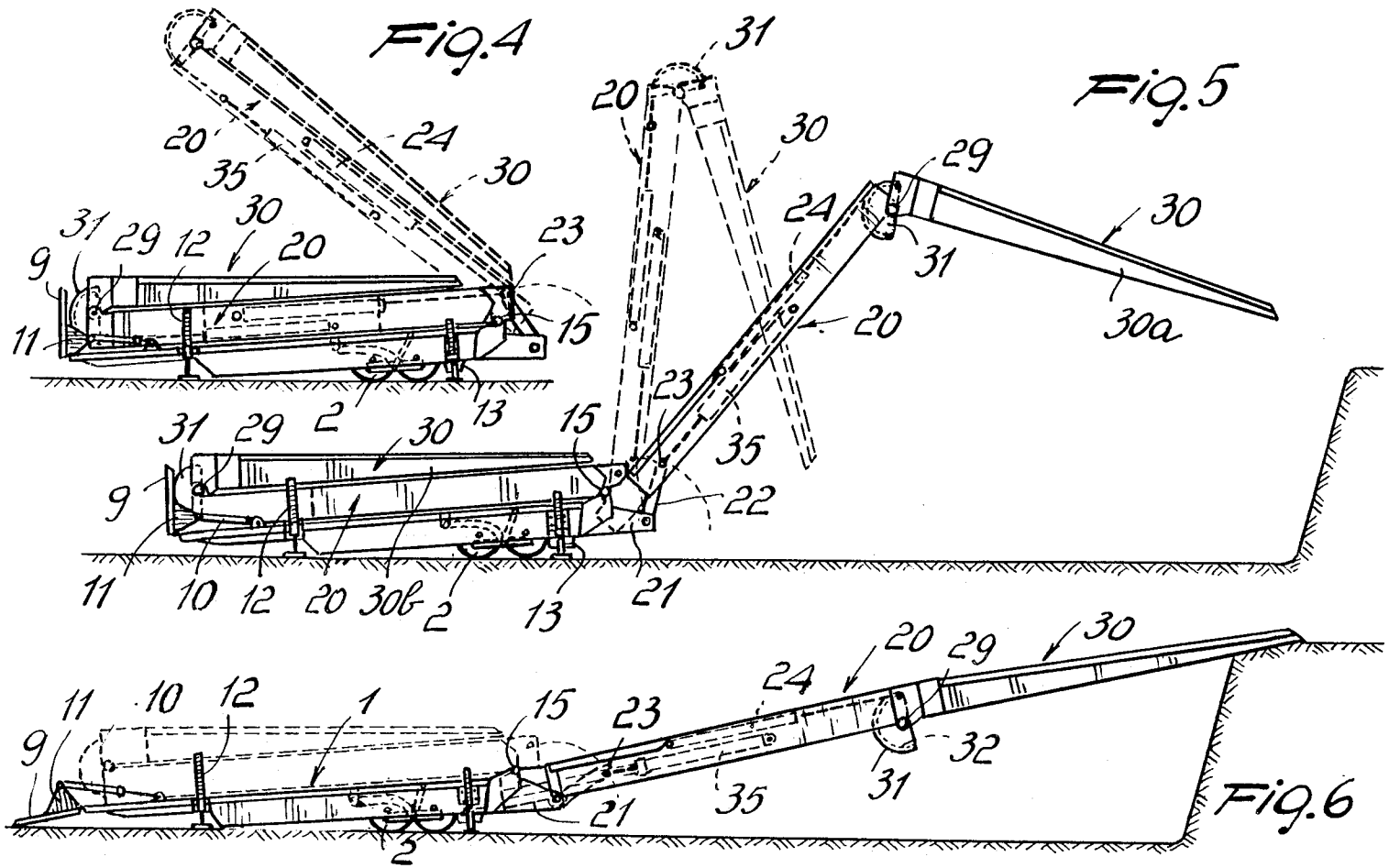
FIG. 4 is a schematiC elevation view of the bridge with the step of rotation of the first track indicated in broken lines.
FIG. 5 is a view of a successive step of rotation of a track with an intermediate stage indicated in broken lines.
FIG. 6 is an elevation view of the installed bridge, with the second track shown before being positioned and indicated in broken lines.

With reference to the above described figures, the automatic-assembly bridge, ramp and the like according to the invention comprises a base segment, generally indicated by the reference numeral 1, which is advantageously but not necessarily defined by two sections which are divided longitudinally so that they can be easily transported; during installation , the two sections are rigidly coupled to one another so as to form said base segment.

Said base segment 1 may naturally also be provided monolithically.

The base segment acts in practice as a mobile frame for road transport.

For this purpose, two sets of four tires 2 each are provided at one end of the base segment, preferably the rear end. Said tires 2 are mounted on rockers 3 so that each wheel is independent from the others so as to ensure correct distribution of the weight on the wheel even on uneven ground.

The two sets of wheels 2 are provided with an easily adjustable hydropneumatic suspension 4.

The vertical positioning of the wheels is adjusted by means of hydraulic pistons 5 which act on the rocker-holder arm 6 so that the set of wheels can be raised or lowered as required and in particular so that it can be retracted at least partially within the base segment so as to disengage from the ground when the bridge or ramp is installed.

On each set, the two rear wheels are equipped with pneumatic brakes, according to international norms, complete with all auxiliary elements.

Compressed air is drawn from the tractor, and an auxiliary compressed air tank is furthermore accommodated in the base segment.

Said base segment defines, at the other end but on the same face, an articulation 7 for its articulated coupling to the tractor 8.

A tilt-down flap or skid 9 is pivoted at the front end of the base segment and has the function of facilitating the access of vehicles to the bridge by eliminating the difference in level on the access side which occurs due to the different inclinations which the bridge may assume.

Said tilt-down flap is actuated by a front hydraulic piston 10 which is hinged or pivoted to the base segment at one end and, at the other end, to a gusset 11 rigidly associated with the tilt-down flap or skid 9.

Hydraulic jacks 12 are provided at the front end of the base segment and have the function of lifting and supporting the base segment in its front part during the operations for uncoupling it from the tractor and for coupling it thereto.

Rear stabilizers 13 are furthermore arranged proximate to the set of wheels 2 and can be extracted and lowered hydraulically from the base segment so as to ensure the necessary stability during the opening and closure of the segments, as will become apparent hereinafter, and to make sure the base segment rests properly on the ground when the bridge is in operating position.

In a middle region, the base segment furthermore defines a seat for the accommodation of a hydraulic control unit 14 which supervises the operation of the bridge's hydraulic systems.

The pipes directed toward the secondary hydraulic services are connected directly to the control unit, while the pipes for the primary services, i.e. those required to open and close the segment, are made of steel as regards the section provided inside the base segment and are then connected by means of very-high-pressure flexible tubes to the successive segments where the opening and closure cylinders are provided.

The base segment is pivoted at its rear end by means of large-size hinges 15 to a second segment, generally indicated by the reference numeral 20, which is defined by two tracks **20*a* and 20*b*** which are arranged side by side along their longitudinal extension.

Brackets 21 are provided at the rear end of the base segment, and tension elements 22 are articulated thereto; in turn, said elements are connected to sliding heads 23 of hydraulic cylinders for lifting the second segment which are indicated by 24 and are accommodated inside said second segment.

The two tracks **20*a* and 20*b* can be folded over independently from one another by means of the hydraulic actuation of the lifting cylinder 24, which rotates each track of the second segment with respect to the base segment by means of the tension element provided between the head of the hydraulic cylinder 24 and the bracket 21**.

In this movement, the hydraulic cylinder exerts a traction force, during a first rotation step, until the second segment arranges itself substantially vertically with respect to the base segment; once said second segment has become vertical, said cylinder acts as braking element until positioning is completed.

This kind of coupling allows a mutual rotation of approximately 200° about the hinge 15 which is provided by means of a single hydraulic cylinder for each track, as does not occur in the solutions of the known art.

An end segment 30 is pivoted to the other end of the second segment and is also constituted by a first track **30*a* and by a second track 30*b* which are pivoted to the second segment by means of a second hinge 29**.

Each track of the third segment has a semi-circular element 31 rigidly associated therewith concentrically to the hinge 29; said semi-circular element has an accommodation for a metallic cable 32 which is connected to hydraulic cylinders 35 for rotating the third segment which are accommodated in the second segment.

The two tracks of the third segment 30 are turned over by virtue of the hydraulic movement performed by means of the hydraulic piston 35.

Figures 8, 9, 10:
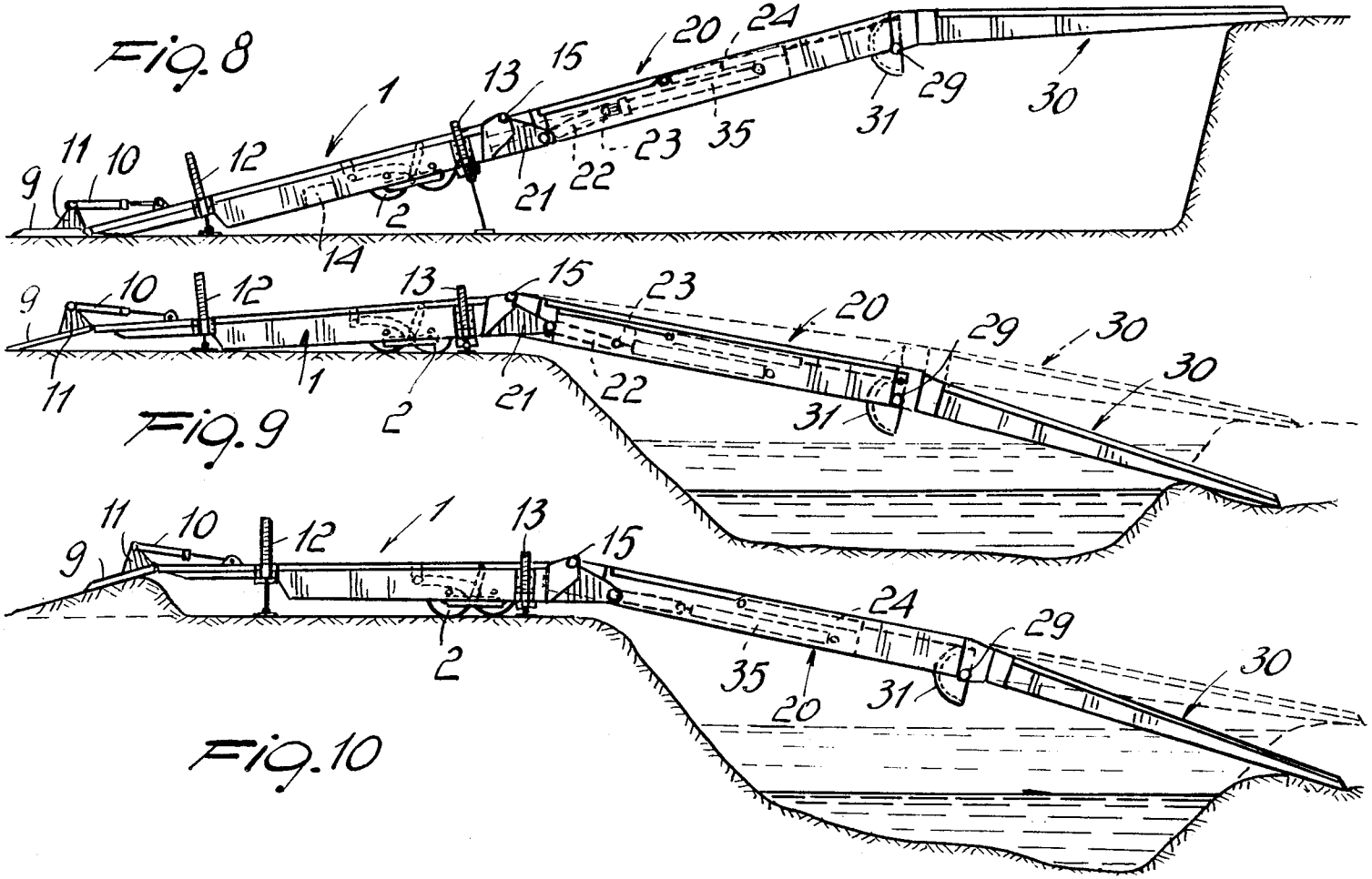
FIGS. 8, 9 and 10 are schematic views of possible different kinds of installation of the bridge, ramp or the like according to the invention.

An important characteristic of the invention is constituted by the fact that one of the two tracks acts as ballast for the other track, i.e. during the step of installation of the bridge one track remains initially folded on the base segment while the other track is lifted, rotating it, by overturning the second arm with respect to the base segment and the third segment with respect to the second segment until they are arranged in the required position, as illustrated schematically in FIGS. 7 to 10.

Once one track has been completely unfolded and positioned, the other track can be unfolded.

As is thus apparent, an automatic-assembly bridge is provided which includes all the means required for its unfolding and folding without having to resort to external lifting devices.

Another characteristic aspect is furthermore constituted by the fact that the mutual rotation between the segments is obtained by means of hydraulic cylinders of appropriate size which act between one segment and the other.

The fact that a part of the segments themselves is used as ballast during the unfolding of the other part of the segments is furthermore very important. This characteristic allows to always have maximum safety conditions during the bridge installation step.

The invention thus conceived is susceptible to numerous modifications and variations, all of which are within the scope of the inventive concept.

All the details may furthermore be replaced with other technically equivalent elements.

In practice, the materials employed, so long as compatible with the specific use, as well as the dimensions and contingent shapes, may be any according to the requirements.

I claim:

1. Automatic-assembly ramp-like bridge comprising a base segment, at least one set of wheels, positioning means, releaseable coupling means, and at least one second segment, said at least one set of wheels being associated with one side of said base segment, said positioning means acting on said at least one set of wheels to position said at least one set of wheels relative to said base segment, said releasable coupling means being associated with said ramp-like bridge, for at least temporarily coupling said ramp-like bridge to tractor means adapted for transporting said ramp-like said at least one second segment being articulated to one end of said base segment, said at least one second segment comprising a first track and a second track, said first track and said second track being arranged side-by-side and being independently rotatable relative to said base segment between a transport position, in which said first track and said second track are superimposed on said base segment, and an installation position, in which said first track and said second track are arranged substantially along the extension of said base segment, one of said first track and said second track being adapted to act as ballast during rotation of the other track.

2. Ramp-like bridge according to claim 1, comprising a third segment, said third segment being articulated to said at least one second segment at one end of said at least one second segment opposite with respect to articulation of said at least one second segment to said base segment, said third segment comprising a third segment first track and a third segment second track, said third segment first track and said third segment second track being arranged side-by-side and being independently rotatable relative to said at least one second segment.

3. Ramp-like bridge according to claim 1, further comprising a system of rockers and a hydropneumatic accumulator, said at least one set of wheels being mounted on said system of rockers for distributing weight of said ramp-like bridge on said at least one set of wheels, said at least one set of wheels being controlled by said hydropneumatic accumulator.

4. Ramp-like bridge according to claim 1, further comprising a system of rockers, said at least one set of wheels being mounted on said system of rockers for distributing weight of said ramp-like bridge on said at least one set of wheels, said base segment defining a body, said positioning means for positioning said at least one set of wheels relative to said base segment being constituted by a set of hydraulic pistons, said set of hydraulic pistons being associated with said system of rockers for at least partially retracting said at least one set of wheels into said body of said base segment.

5. Ramp-like bridge according to claim 1, said releaseable coupling means being constituted by an articulation.

6. Ramp-like bridge according to claim 1, further comprising a tilt-down flap and an auxiliary piston said tilt-down flap being hinged to one end of said base segment opposite with respect to articulation of said at least one second segment to said base segment, said tilt-down flap being actuated by said auxiliary piston, said auxiliary piston being connected between said base segment and gussets fixed to said tilt-down flap.

7. Ramp-like bridge according to claim 1, further comprising a system of coupling hydraulic jacks, said system of coupling hydraulic jacks being arranged near said coupling means and being adapted to support said base segment during coupling and uncovering of said ramp-like bridge from said tractor means.

8. Ramp-like bridge according to claim 1, further comprising rear stabilizers associated with said base segment, said rear stabilizers being extractable from said base segment to thereby position said base segment.

9. Ramp-like bridge according to claim 1, further comprising a hydraulic control unit being supported by said base segment, said hydraulic control unit being adapted to control hydraulic systems of said ramp-like bridge.

10. Ramp-like bridge according to claim 1, wherein said at least one second segment is pivoted to said base segment by means of a hinge, said hinge being arranged rearwardly on said base segment.

11. Ramp-like bridge according to claim 1, further comprising for each said track a bracket, a tension element, and a hydraulic lifting cylinder having a sliding head, said bracket rearwardly protruding from said base segment, said hydraulic lifting cylinder being accommodated in one of said tracks, said sliding head of said hydraulic lifting cylinder being thereby rearwardly arranged, said tension element being pivoted at one end thereof to said bracket and being hinged at another end thereof to said sliding head, whereby said sliding head slides by actuation of said hydraulic lifting cylinder which thereby generates a rotation of said one of said tracks relative to said base segment.

12. Ramp-like bridge according to claim 2, wherein said third segment is pivoted to one end of said at least one second segment opposite with respect to the end of said second segment where said base segment is connected.

13. Ramp-like bridge according to claim 2, wherein each said third segment is provided with a semicircular element, said semicircular element being arranged concentrically to a rear hinge, said rear hinge being used for pivoting said third segment to said at least one second segment, an hydraulic cylinder being provided for rotating said third segment relative to said at least one second segment, said semicircular element defining an accommodation for a cable, said cable being connected between said hydraulic cylinder and said third segment.

14. Ramp-like bridge according to claim 2, wherein an unfolding of at least one second segment and said third segment is achieved by initially unfolding one of said tracks of said at least one second segment and also unfolding one of said third segment tracks attached to said one of said tracks and subsequently unfolding said other said track of said at least one second segment and also unfolding another of said third segment tracks attached to said one other track.

15. Automatic-assembly ramp-like bridge comprising a base segment, at least one set of wheels, positioning means, releaseable coupling means, and at least one second segment, said at least one set of wheels being associated with one side of said base segment, said positioning means acting one said at least one set of wheels to position said at least one set of wheels relative to said base segment, said releasable coupling means being associated with said ramp-like bridge for at least temporarily coupling said ramp-like bridge to tractor means adapted for transporting said ramp-like bridge, said at least one second segment being articulated to one end of base segment, said at least one second segment being rotatable relative to said base segment between a transport position, in which said at least one second segment is superimposed on said base segment, and an installation position, in which said at least one second segment is arranged substantially along the extension of said base segment.

* * * * *